US007823861B2

(12) United States Patent
Krug

(10) Patent No.: US 7,823,861 B2
(45) Date of Patent: Nov. 2, 2010

(54) SMALL VEHICLE JACK APPARATUS

(75) Inventor: Norman J. Krug, Atlanta, KS (US)

(73) Assignee: Mojack Distributors, LLC, Wichita, KS (US)

( * ) Notice: Subject to any disclaimer, the term of this patent is extended or adjusted under 35 U.S.C. 154(b) by 980 days.

(21) Appl. No.: 11/147,571

(22) Filed: Jun. 8, 2005

(65) Prior Publication Data

US 2006/0278855 A1 Dec. 14, 2006

(51) Int. Cl.
*B66F 7/26* (2006.01)

(52) U.S. Cl. ..... 254/4 B; 254/133 R; 254/134; 414/426

(58) Field of Classification Search ..... 254/2 B, 254/4 B, 8 B, 7 B, 133 R, 134; 414/426, 414/427

See application file for complete search history.

(56) References Cited

U.S. PATENT DOCUMENTS

| | | | | |
|---|---|---|---|---|
| 2,867,409 | A | 1/1959 | Southerwick | |
| 2,992,811 | A | 7/1961 | Turner | |
| 3,038,700 | A | 6/1962 | Ascherl | |
| 3,306,579 | A | 2/1967 | Campbell | |
| 4,066,243 | A * | 1/1978 | Johnson | 254/133 R |
| 4,123,038 | A * | 10/1978 | Meyers | 254/2 R |
| 4,549,721 | A * | 10/1985 | Stone | 254/126 |
| 4,645,181 | A | 2/1987 | Schapansky | |
| 5,358,217 | A * | 10/1994 | Dach | 254/2 R |
| 5,366,338 | A | 11/1994 | Mortensen | |
| 6,439,346 | B1 | 8/2002 | Gradzuik | |
| 6,474,626 | B1 * | 11/2002 | Box | 254/131 |
| D468,512 | S * | 1/2003 | Hernandez | D34/28 |
| 6,516,597 | B1 * | 2/2003 | Samejima et al. | 56/16.7 |
| 6,601,825 | B2 * | 8/2003 | Bressner et al. | 254/4 R |
| 2006/0045710 | A1 | 3/2006 | Hiebert | |
| 2006/0278855 | A1 * | 12/2006 | Krug | 254/4 B |
| 2006/0278856 | A1 * | 12/2006 | Krug | 254/4 B |
| 2009/0134374 | A1 * | 5/2009 | Krug | 254/4 B |

FOREIGN PATENT DOCUMENTS

| | | | |
|---|---|---|---|
| CH | 526 463 | A | 8/1972 |
| FR | 2 781 779 | A1 | 2/2000 |

(Continued)

OTHER PUBLICATIONS

International Search Report of corresponding international application PCT/US2009/057092, dated Dec. 15, 2009.

(Continued)

*Primary Examiner*—Lee D Wilson
(74) *Attorney, Agent, or Firm*—Alston & Bird LLP

(57) ABSTRACT

A small vehicle jack, having the ability to lift vehicles having a variety of wheel bases, and axle configurations. A support frame provides stability for a vertical bar, which supports a winch means. The winch means raises a lifting frame using a strap means, and the lifting frame which follows the vertical bar using an improved sleeve means, in which rollers are used on either side of the vertical bar. The jack may have adjustable and detachable wheel support means, in which the wheels of the vehicle are used as the contact points to raise the vehicle. The jack may also be used without wheel support means, but instead use hook means to attach to an axle.

8 Claims, 4 Drawing Sheets

FOREIGN PATENT DOCUMENTS

| | | | |
|---|---|---|---|
| GB | 885 599 | A | 12/1961 |
| JP | 62 108396 | U | 7/1987 |
| JP | 63 021695 | U | 2/1988 |
| JP | 2005 145571 | A | 6/2005 |
| WO | WO 96/26886 AI | | 9/1996 |
| WO | WO 99/11556 | A1 | 3/1999 |
| WO | WO 2010/047897 | A1 | 4/2010 |

OTHER PUBLICATIONS

Written Opinion of corresponding international application PCT/US2009/057092, dated Dec. 15, 2009.

International Search Report of corresponding international application of PCT/US2010/024902, dated Jun. 9, 2010.

Written Opinion of corresponding international application PCT/US2010/024902, dated Jun. 9, 2010.

Office Communication mailed Jul. 18, 2008 in connection with related U.S. Appl. No. 11/327,264, filed Jan. 7, 2006 (abandoned).

Office Action mailed Apr. 8, 2008 in connection with related U.S. Appl. No. 11/327,264, filed Jan. 7, 2006 (abandoned).

Office Action mailed Feb. 8, 2008 in connection with related U.S. Appl. No. 11/327,264, filed Jan. 7, 2006 (abandoned).

* cited by examiner

SMALL VEHICLE JACK APPARATUS

BACKGROUND OF THE INVENTION

Referring now to U.S. Pat. No. 4,066,243 (Johnson), a jack for the use with automobile bumpers is shown, in which a frame is provided as a support means for a vertical pipe, which has a sleeve, which moves upward and downward around said pipe. A typical floor jack provided the upward lifting force against the sleeve, where the floor jack was attached to the sleeve portion through a ring. This device required a secondary jack, and was limited to the lifting of a vehicle body parts which would comprise a bumper.

Referring now to U.S. Pat. No. 4,123,038 (Meyers), an apparatus is disclosed in which an elaborate load bearing frame is provided, where the apparatus operates using two separate hydraulic jacks. There is no realistic application of this type of device with a small tractor or riding lawn mower.

Portable jacks for small tractors are specifically exampled in U.S. Pat. No. 4,549,721 (Stone), in which a screw-scissors jack was operated to provide lifting force against a framework so as to push the framework upward. It would appear that one of the drawbacks of this invention was that the framework had a rectangular configuration, which would create a problem where a portion of the framework had to be moved under the tractor front wheels. This requirement would present a problem in a situation where the tractor was unable to move under its own power, requiring physical work to move the tractor over the framework assembly. Further, this device would not work properly at a location where the ground on which the tractor was situated was not properly leveled.

Referring now to U.S. Pat. No. 5,358,217 (Dach), the lifting apparatus is disclosed, in which a framework had a narrow front end, and avoided some of the problems inherent in the Stone patent referenced above. This system required a hydraulic cylinder to provide an upward pushing force to lift the item or vehicle. Extended arms had curved metal prongs that were referenced as lifting points. This jack was not intended for use with small tractor wheels, but rather were intended for axle assemblies.

Referring now to U.S. Pat. No. 6,474,626 (Box), a rack for securing a lawn mower to an elevated position is shown, in which a cage-like framework assembly is provided, and where a flexible webbing is used with a wheel crank to pull the entire lawn mower into an elevated position. This assembly is similar to an automobile rack, with the exception that the lifting framework is rectangular in nature, and supports all four wheels of a push mower on rack.

Further patents have disclosed jacking mechanisms with riding lawn mowers. U.S. Pat. No. 6,516,597 (Samejima et al.) discloses a lawn tractor which allows manipulation of its wheel supports into position so that they can be used to assist in raising up the front end of the lawn tractor.

Referring now to U.S. Pat. No. D 468,512 S (Hernandez), an all-terrain vehicle lift is disclosed, in which a hydraulic cylinder is used, to lift a metal framework that is disposed at the front end of the apparatus. The invention uses a rectangular frame, and a support means for the wheel is limited to a single tire, and not to two wheels, unless they are fairly close together.

SUMMARY OF THE INVENTION

From time to time, small tractors, riding lawnmowers, and other similar vehicles require maintenance requiring that one end of the vehicle be elevated. The use of hydraulic floor jacks do not always provide a single stable support structure, and jack stands are often the wrong size with regard to the elevation requirements for the small vehicles. In some situations, the angle of the vehicle necessary to accomplish the desired elevation of one end of the vehicle, makes the use of small jacks unwieldy, since small hydraulic system jacks only have a single contact point. As the contact point rotates by virtue of the elevation difference between the front and back end of the vehicle, the contact point with the hydraulic jack may become unstable. Further, the amount of elevation necessary will often exceed a hydraulic jack assembly's capability.

A complete apparatus is necessary, where the wheels of the vehicle may be used to elevate the entire end of a vehicle, rather than relying on the frame or other similar contact points available with typical hydraulic jacks for such a vehicle. A means to provide use of a jack with a stationary vehicle is desired, where the supporting structure can be moved into position on a vehicle, without requiring movement of the vehicle onto the jack means itself.

This invention comprises a small portable jack that is intended for use with small tractors, riding lawn mowers, four-wheel sport motorcycles, and other small vehicles. This small vehicle jack support system obviates the need for hydraulic systems, but instead uses a vertical jack bar with a winch system and flexible strap on top of the apparatus to provide the lifting force.

The jack itself has a base that defines a stable platform, also referred to as a support frame, that is intended to slide underneath the front end of the tractor or other vehicle. This jack may also be used on the back end of the tractor or other similar vehicle, but for purposes of discussion, the front end of the vehicle will be used as the example with the lifting method and apparatus for this invention.

The forward framework that slides under the tractor is wider at the front for maximum stability, and narrows toward the rear, with the rear portion of framework able to be attached to an axle and wheel assembly. A vertical frame bar is fixed in position where the axle and wheel assembly and rearmost ends of the framework meet. The vertical frame bar is positioned between the rear frame members, and projects upward.

A lifting frame is provided, in which a center bar is connected at its front end perpendicularly to a cross bar member, where said cross bar member has a length that is equal to or greater then the width of the support frame from side to side. The crossbar and center bar define a T-shaped structure. The crossbar sits upon the support frame, with its ends resting on crossbar rest members, where the crossbar rest members define the widest portion of the support frame.

The center bar has a rigid guide member fixed to each side of the center bar rear end, where the guide members are slightly angled rearward from a 90 degree or perpendicular setting. Each guide member is spaced apart and parallel to each other, defining a gap that is at least as wide as the width of the center bar. The center bar preferably has a width greater than the vertical frame bar. As the guide members are parallel to each other, they allow the vertical frame bar to be positioned between them.

Once the lifting frame is positioned so that the vertical frame bar is situated between the angled guide members, a top roller is placed through its receiving apertures located on the terminating ends of the guide members, so that the vertical frame bar is restrained within the guide member gap area. A bottom roller is also positioned on the opposite side of the vertical frame bar, through the side guide members. The bottom roller, the parallel guide members and top roller function as a sleeve, which fits around the vertical frame bar, allowing the lifting frame to be moved upward and downward, with the gap between the guide members allowing some limited horizontal motion of the lifting frame. This allows for easy adjustment to the position of the lifting frame.

The vertical frame bar supports a winch means on its top end, with a flexible strap providing the pulling force necessary to lift the vehicle. In instances where the apparatus is desired to have height adjustment capability, a separate extension bar is provided, which allows the vertical bar, without any top structures attached, to be inserted into the extension bar.

The extension bar is provided, when greater height is desired, than can be obtained from a standard vertical frame bar. Also, the separate extension bar is provided for the simple need of disassembly and storage when so desired. Since both situations are generally desired, a extension bar is typically used with this apparatus.

The extension bar defines an inner cavity which allows the length of the vertical frame bar to be inserted completely into the extension bar. The extension bar preferably has a width similar to the center bar, with the gap defined between the guide members sufficient to allow said guide members to move freely over the extension bar.

The extension bar supports a platform which in turn supports a geared winch system that operates a flexible strap. The end of the flexible strap defines a hook, which is able to connect to a lifting ring located on the center bar, in proximity to the guide member attachment points with the center bar.

Removable wheel supports are provided, which are defined by a horizontal shaft, with a crossmember spacer which defines prongs on each end of the spacer, with the prongs defining a horizontal extension that is able to impact against the bottom side of a wheel. The prongs are spaced apart to define a gap, with the wheel able to rest between said gap. The wheel support assembly is attached to the crossbar by sliding the shaft into the inlet of said crossbar and securing the shaft and crossbar to each other.

Once the wheels of the vehicle are secured within the gap between the wheel support spacer prongs, the handle of the winch assembly is turned, causing the flexible strapped to move upward, thus exerting a lifting force against the lift ring. The lifting frame is raised vertically. The weight of the vehicle on the cross bar maintains the orientation of the lifting frame in a fairly horizontal position. The frame is unable to angle downward due to do the top and bottom roller. The strap is withdrawn until the lifting frame has raised the vehicle to the desired level. The winch is locked in position, using the braking systems commonly associated with such winch systems.

One advantage of having a separate extension bar is that the overall height capabilities of the jack can be varied, according to the length of the extension bar. Use of the strap denies the need for any type of hydraulic system, with the winch apparatus providing sufficient force to the strap, especially if the winch apparatus has a geared ratio with regard to the handle movement.

DETAILED DESCRIPTION OF THE INVENTION

Figure 1:
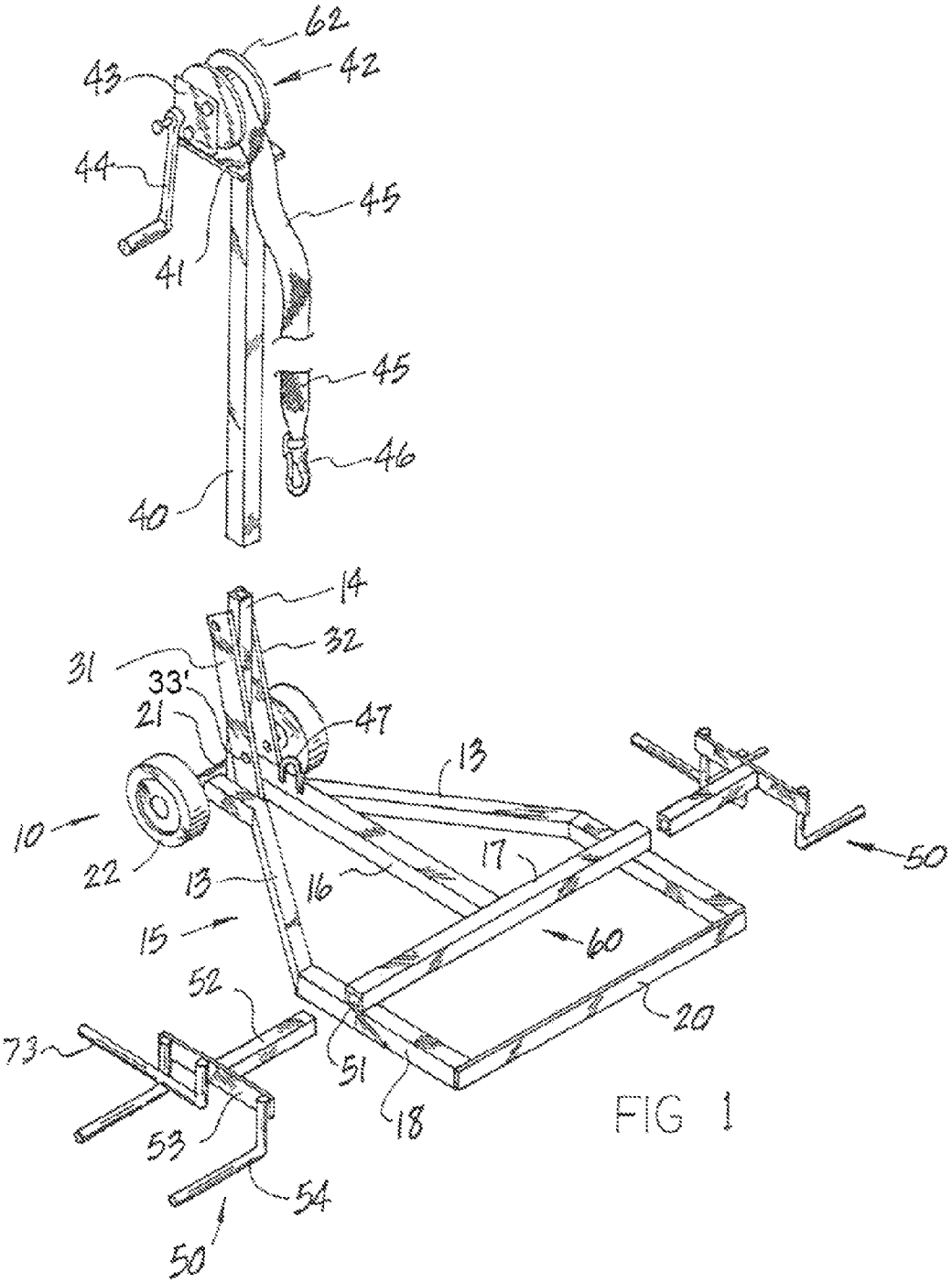
FIG. 1 is a perspective view of the improved small vehicle jack, in which the wheel support means and extension bar are shown in an exploded view.

Referring to FIG. 1, the improved small vehicle jack apparatus 10 is shown. Said apparatus 10 is comprised of a support frame 15, a lifting frame 60, a lifting means 42, and a wheel support means 50. The support frame 15 is comprised of two generally parallel crossbar rest members 18 and 19, which are spaced apart by a front member 20. These members 18, 19 and 20, comprise the portion of the support frame 15 that is actually intended to be moved underneath the vehicle.

The crossbar rest members 18 and 19 are attached to the front member 20 ends, with angled members 13 fixed to the crossbar rest member 18 and 19 rear ends. The angled side members 13 are angled in relation to each other so that the distance between them becomes closer toward each other along their length from the front toward the rear. The rear ends of the angled side members 13 define end portions 25 that are fixed in relation to each other and which allow a vertical frame bar 14 to be fixed in a vertical position at the rear portion of the apparatus 10.

As FIG. 1 shows, an axle 21 is provided, which is fixed to the rear end of this apparatus 10, and which supports wheels 22 located on either side of said support frame 15. The wheels 22 are fixed in such a manner that the rear portion of the support frame 15 is able to rest on the ground, with the wheels 22 providing ground contact for the rear portion of the support frame 15 if the apparatus 10 is tilted backwards. It should be understood however, that wheels 22 are not required, but are shown in the figures as the preferred manner of construction, since wheels 22 provide for an ease of transportation, in which the support frame forward end is elevated, with the ground contact being borne solely by wheels 22. This allows ease of movement of the entire apparatus 10.

The gap between the rear end portions 25 of the support frame 15 should be wide enough so as to accommodate the center bar 16 of the lifting frame 60, and any sleeve means utilized with said lifting frame 60.

Figure 2:
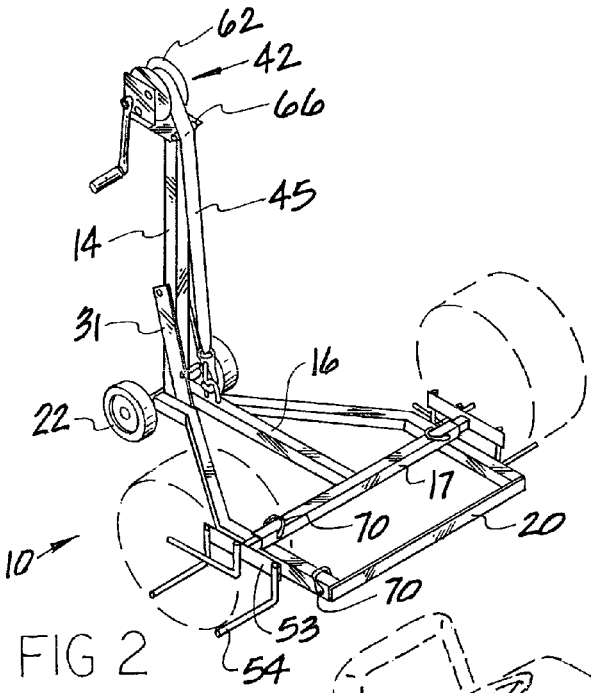
FIG. 2 is a perspective view of the improved small vehicle jack in which the vertical frame bar and comprises the vertical support for the winch system.

The fixed vertical frame bar 14 projects upward from the support frame 15. FIG. 1 shows a separate extension bar 40, which fits down over the vertical frame bar 14. In one of the preferred embodiments, there is no separate extension bar 40, but the support frame 15 and incorporated vertical frame bar 14 support the winch means 42. As is shown in FIG. 2, the vertical frame bar 14 is fixed to the rear ends 25 of the support frame 15, and projects upward and supports a platform 41 and onto which a winch means 42 is provided. The winch means 42 is comprised of a spool, 62, a winch support 43 that fixes the position of the spool 62, and a handle 44, whose manipulation causes a geared assembly to cause the spool 62 to turn to take up or let out the length of the strap 45.

A flexible strap 45 is shown in FIG. 1 and in FIG. 2, where said strap 45 is wound about the spool 62, with its terminating end defining a hook 46. The flexible strap 45 is fed off of the spool 62, and a roller 66 is preferably provided at the edge of the platform 41 which supports the winch means 42. The flexible strap 45 is not limited to any type of specific material, but could include any type of flexible material that has durability and strength in its resistance to stretching and/or breakage. The term "strap" should be understood to include chains, cables, straps of various material, cords, in any other type of flexible straps may be used, and will all function in virtually the same manner.

As is shown in FIG. 2, the support frame 15 and incorporated vertical frame bar 14 comprise a general L-shaped configuration, where the total height of the apparatus 10 will always be consistent with the height of the vertical frame bar 14 and winch assembly 42.

FIG. 1 shows an embodiment of the apparatus 10 in which the vertical frame bar 14 has the same configuration, except that it is much shorter in FIG. 1 than it is in FIG. 2. In FIG. 1, an extension bar 40 operates as an extender of the vertical frame bar 14. The extension bar 40 may have any overall length desired by the operator of this apparatus 10. In this manner, the interchangeability of various extension bars 40 with a single support frame 15 and vertical frame 14, allows for a single support frame 15 to provide possibility for an apparatus 10 that has multiple choices of overall height as to the orientation of winch assembly 42. The winch assembly 42 as described for FIG. 2 operates in the same manner as the winch assembly 42 in FIG. 1. The winch assembly 42 may be detachable from the extension bar 40, so that a single winch assembly 42 and support frame 15 may be used with extension bars 40 of various lengths to create a jack apparatus 10 of varied overall heights.

The lifting frame is comprised of a center bar 16, which is attached at its front end to a crossbar 17, where said crossbar and center bar form a T-shaped structure. The crossbar 17 preferably has a length that is equal to or greater then the distance defined by the separation of crossbar rest members 18 and 19. The crossbar 17 is preferentially perpendicular to the crossbar rest members 18 and 19, with the terminating ends of the crossbar 17 able to sit on top of the respective crossbar rest members 18 and 1 9.

Wheel support means 50 are provided, which are shown as being detachable in FIG. 1 and in FIG. 2. It should be understood, that the detachability of the wheel support means 50 is considered to be an optional and a more advanced feature, than if the wheel support means 50 was permanently attached and made a part of the terminating ends of the crossbar 17.

As FIG. 1 shows, the wheel support means 50 is comprised of a main shaft 52, which supports a spacer 53, where said spacer 53 is oriented at 90° from the shaft 52 to form a T-shaped configuration. Prongs 54 are attached at each end of the spacer 53, and project outward away from the apparatus 10. As FIG. 1 shows, the prongs 54 are defined and shown as L-shaped members, in which the horizontal portion of the prong 54 is lower than the spacer 53 and shaft 52. This is a preferred embodiment, since the horizontal portion of the prongs 54 are able to rest on the ground, while the crossbar 17 of the lifting frame 60 rests on top of the support frame 15.

The wheel support means 50 may be detachable from cross bar 17, in which the shaft 52 of the wheel support means 50 has an outer dimension that is at least less than the dimensions defined by insert 51, which comprises the opening into the interior of crossbar 17. Shaft 52 is moved into insert 51 until a desired position is reached, at which time both the shaft 52 and cross bar 17 are secured to each other using a securing pin 70, which is shown in use in FIG. 2. Such securing pins are common in the art.

Figure 5:
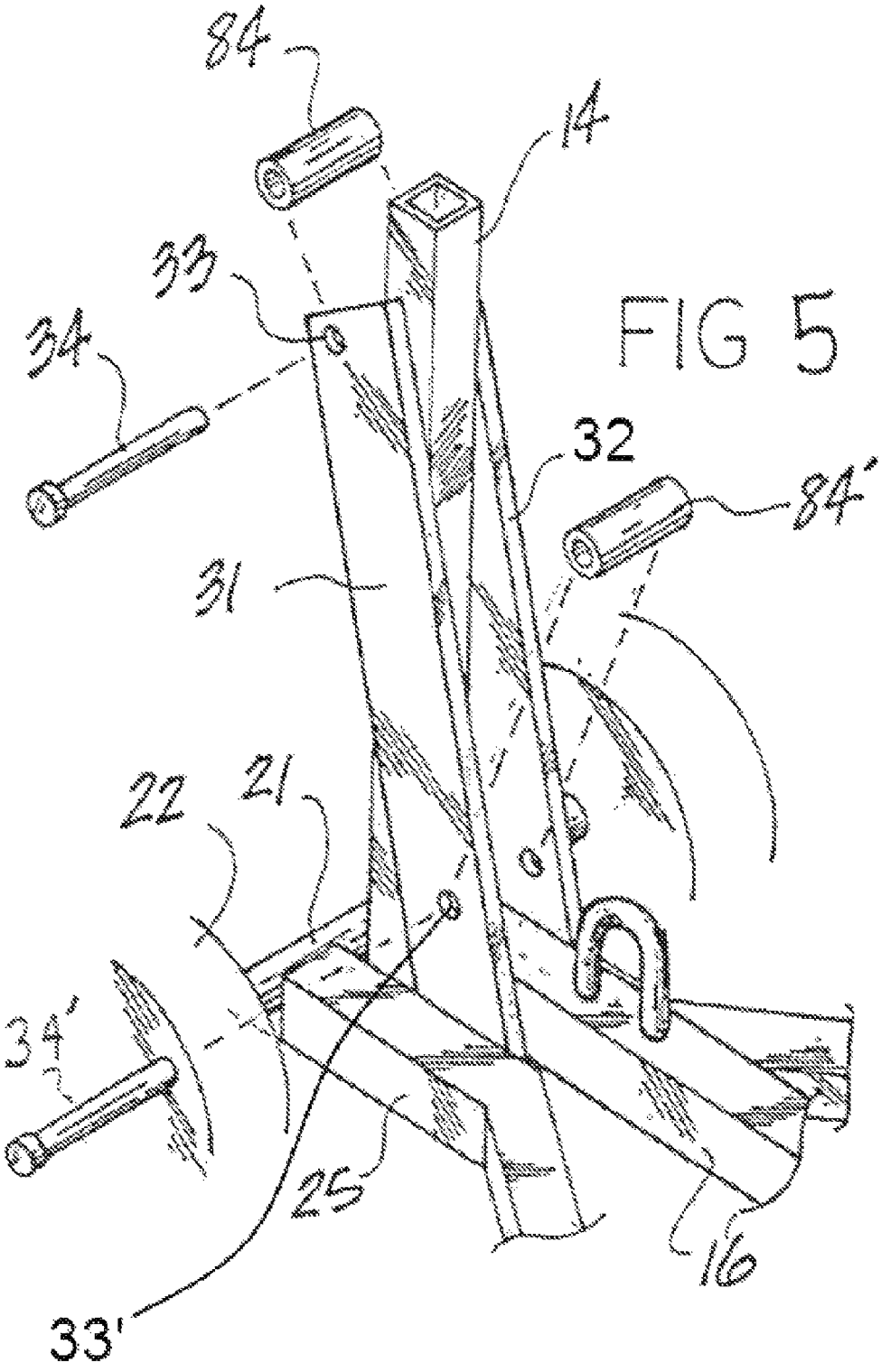
FIG. 5 is an enlarged view of the sleeve assembly, showing the guide members and the top and bottom roller.

The lifting frame 60 is fixed in position with regard to the vertical frame bar 14, or where a extension bar 40 is used, fixed in position to the extension bar 40 through a sleeve means. Referring now also to FIG. 5, a sleeve means comprises the rear end of center bar 16, in which guide members 31 and 32 are secured to the sides of the center bar 16, being secured at a slight rearward angle, as compared to a vertical position, so that the guide members 31 and 32 project both upwards, and slightly toward the rear.

Figure 6:
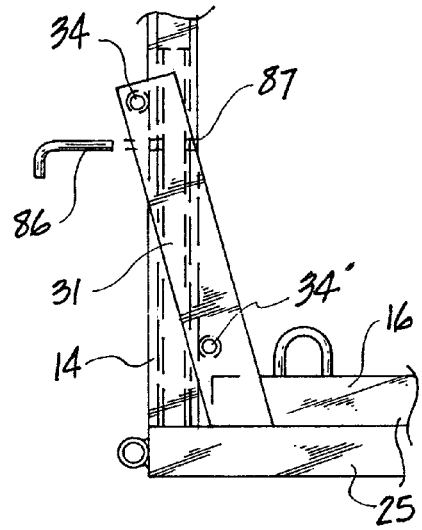
FIG. 6 is a side view of the sleeve means, in which the guide member is shown, with the lower and upper rollers shown, and where the safety pin is also shown.

Referring to FIGS. 5 and 6, the gap defined between the guide members 31 and 32 allows for placement of the vertical frame bar 14, or the extension bar 40 where one is used, with a top roller 84 placed over a top roller axle 34, which axle extends through top axle receiving apertures 33 defined on the ends of guide members 31 and 32. A bottom roller 84' is situated between the side guide members 31 and 32, in the manner of the top roller 84, with the bottom roller 84' over a bottom roller axle 34', which axle extends through bottom axle receiving apertures 33', the bottom roller 84' being further positioned above the center bar 16, but adjacent to the vertical frame bar 14. The rollers 84 and 84' allow the lifting frame 60 to move smoothly upward and downward along the length of the vertical bar 14, or any extension bar 40, where one is used. The vertical frame bar 14, or the extension bar 40, when so situated between the guide members 31 and 32, will provide a guide that the lifting frame 60 can follow in a vertical manner.

Figure 3:
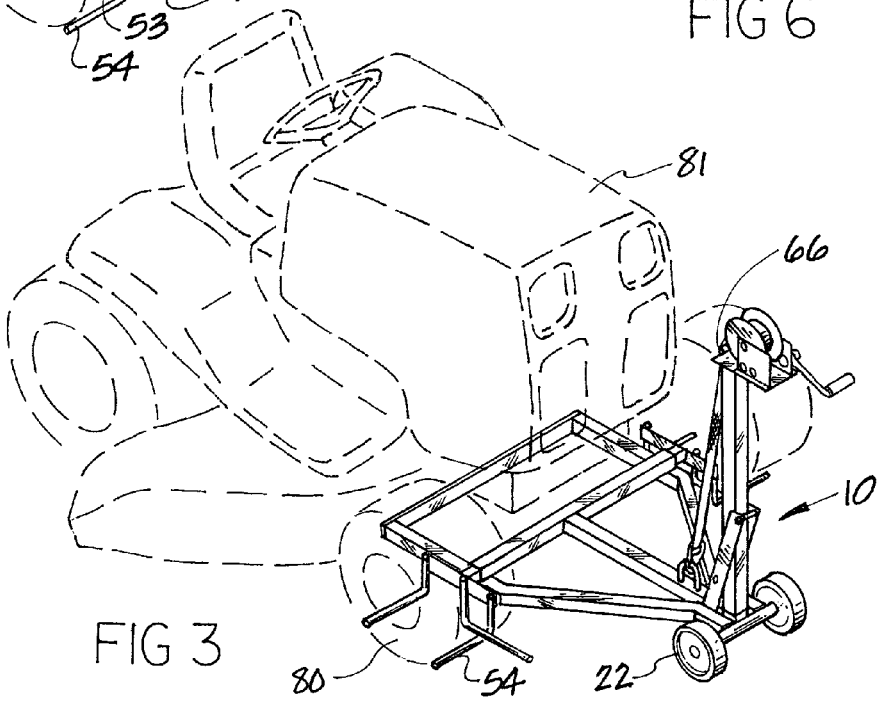
FIG. 3 is a perspective view from above a riding lawn mower with the improved small vehicle jack positioned underneath it, with the tires of the riding mower positioned above the wheel support means.

Operation of the apparatus 10 is accomplished by attaching the hook 46, which is located on the end of the strap 45, to a lifting ring 47, which is located on the center bar 16. Lifting ring 47 is depicted as an inverted U-shaped member that is fixed to the top side of the center bar 16. It should be understood that any manner of connecting the strap 45 to the center bar 16 is understood to be contained within this embodiment. The strap 45 may be tied, or use any other connector means commonly known and understand in the art.

Where the wheel support means 50 are not detachable, the apparatus 10 must be positioned and the small vehicle 81 moved over the lifting frame crossbar 17 until the wheels 80 of the vehicle are placed in between the wheel support prongs 54. Referring now also to FIG. 3, once the wheels 80 are in position, apparatus may be actuated so as to raise the vehicle 81.

One clear advantage of wheel support means 50 being detachable, is that their relative position to the cross bar 17 can vary. This allows for a proper fit to a wide variety of mowers and small vehicle wheel bases, which may vary from vehicle to vehicle. By sliding the shaft 52 along the length of the insert 51 of cross bar 17, the wheel support means 50 can position the outer side of the spacer 53 against the wheel 80 of the vehicle 81. Since most small vehicles 81 are relatively light, the vehicle 81 is simply pushed or moved forward so that the wheels 80 are positioned between the prongs 54. The wheel support means 50 is then adjusted as to width, to ensure the proper fit.

This apparatus 10 is also useful where the vehicle is difficult to move. Referring back again to FIG. 1, that wheel supports 50 that are detachable, allow the wheels supports 50 to be independently placed around the wheels 80 of the vehicle 81. Once the wheel support means 50 are jointly position, with their shafts 52 oriented toward each other, the support frame 15 and lifting frame 17 are slid underneath the front end of the vehicle 81, until the crossbar 17 is positioned adjacent to the ends of the shafts 52 of each of the wheel support means 50.

Shafts 52 are able to be moved into insert 51, and may be secured using pins 70. This is a particularly advantageous operation, since small vehicles may not be movable under their own power, and the jack assembly 10 is able to be positioned so it can support the vehicle 81 without the vehicle 81 having to be moved at all.

Figure 4:
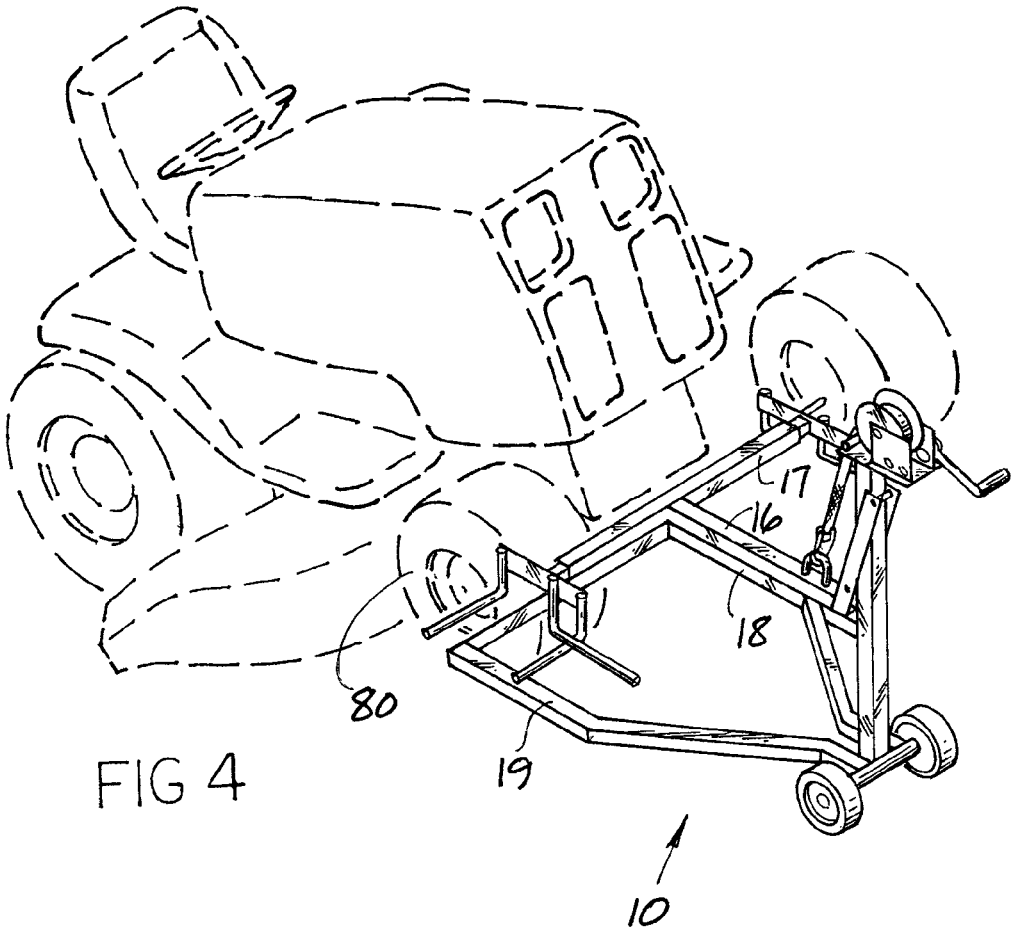
FIG. 4 is a perspective view of the riding mower and vehicle jack, where the jack assembly has been moved to a raised position with the front end of the riding mower shown elevated.

The lifting of the vehicle 81 is accomplished as shown in FIGS. 3 and 4. As FIG. 3 shows, the wheel support means are in the proper position, with the prongs 54 making ground contact. Other points of ground contact would likely comprise the front member 20 and wheels 22. Activation of the winch means 42, is accomplished by turning the handle 44 which causes the length of the strap 45 to be taken up by the spool 62. The strap 45 conveys a pulling force through the hook means 46 to the lifting ring 47 which causes the center bar 16 to move upward.

As the center bar 16, moves upward the weight of the vehicle 81 will be pressing downward on the wheel support means 50. Movement of the center bar 16 will be limited to vertical movement, as a result of the restrictions applied by the guide members 31 and 32 and top roller 34 and bottom roller 84 34. Top roller 34 and bottom roller 84 will prevent the lifting frame 60 from tipping forward, as its forward movement will be prevented by the vertical frame bar 14, or the extension bar 40 if one is used.

Removal of the apparatus 10 from the vehicle 81 involves a reverse process, where the vehicle 81 is lowered to the ground, the wheel support means 50 are slid out of the crossbar 17, and able to be removed from the vehicle area. The support frame 15 and lifting frame 60 are then pulled out from underneath the vehicle.

From the foregoing statements, summary and description in accordance with the present invention, it is understood that the same are not limited thereto, but are susceptible to various changes and modifications as known to those skilled in the art and we therefore do not wish to be limited to the details shown and described herein, but intend to cover all such changes and modifications which would be encompassed by the scope of the appended claims.

I claim:

1. A small vehicle jack, having an adjustable frame height, comprising:

a. a support frame having at side members spaced apart by a front member, with the back portion of said frame having a vertical frame bar;

b. a lifting frame having a center bar, with the forward end of said center bar fixed to a cross bar, and where the back end of the lifting frame defines a sleeve means with the vertical frame bar disposed within said sleeve means;

c. wheel support means, which is fixed to the terminating ends of the cross bar;

d. a extension bar, having sufficient internal diameter so that the vertical frame bar is able to be inserted into the extension bar, where the extension bar serves as an extension of the vertical frame bar; and e. a winch means, fixed to the top of the main frame bar, where said winch means actuates a flexible strap that is able to be attached to the lifting frame, wherein:

the terminating ends of the crossbar comprise a first end and a second end, the first end is adapted to receive a first portion of the wheel support means, and the second end is adapted to receive a second portion of the wheel support means.

2. A small vehicle jack, as recited in claim 1, in which the lifting frame defines an upwardly projecting lifting ring, to which the flexible strap may be attached.

3. A small vehicle jack, as recited in claim 1, in which the flexible strap defines a book at its terminating end.

4. A small vehicle jack, as recited in claim 1, in which the wheel support means is secured to the cross bar using removable pins.

5. A small vehicle jack, as recited in claim 1, in which the support frame defines an axle assembly and wheels as it rearmost end.

6. A small vehicle jack, as recited in claim 1, in which the vertical frame bar has a terminating end, and which is able to be inserted into an extension jack bar, and where the extension jack bar supports the winch means.

7. A small vehicle jack, as recited in claim 1, in which the sleeve means comprises side guide members that are fixed to the center bar, with the terminating ends of the side guide members secured together with a top roller and bottom roller, with a resulting gap defined between the side members, and where the vertical frame bar is disposed between said side members.

8. A small vehicle jack, as recited in claim 1, in which the wheel support means are detachable from a crossbar of the lifting frame.

* * * * *